US008714513B2

(12) United States Patent
Walker et al.

(10) Patent No.: US 8,714,513 B2
(45) Date of Patent: May 6, 2014

(54) MOLD INSERT ASSEMBLY AND METHOD OF USE

(75) Inventors: Michael J. Walker, Windsor (CA); Mark A. Kramarczyk, Sterling Heights, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 742 days.

(21) Appl. No.: 12/899,835

(22) Filed: Oct. 7, 2010

(65) Prior Publication Data

US 2012/0086151 A1 Apr. 12, 2012

(51) Int. Cl.
*B28B 7/30* (2006.01)

(52) U.S. Cl.
USPC ..... 249/178; 249/180; 264/313; 425/577

(58) Field of Classification Search
USPC ..... 249/178, 180; 425/577; 264/313
See application file for complete search history.

(56) References Cited

U.S. PATENT DOCUMENTS

| | | | | |
|---|---|---|---|---|
| 4,279,856 | A | 7/1981 | Vente et al. | |
| 4,456,214 | A * | 6/1984 | Ruck et al. | 249/144 |
| 4,533,312 | A | 8/1985 | Von Holdt | |
| 2006/0188602 | A1* | 8/2006 | Zydron | 425/556 |

FOREIGN PATENT DOCUMENTS

| | | | |
|---|---|---|---|
| CN | 101646514 | A | 2/2010 |
| DE | 3820084 | A1 | 12/1989 |
| EP | 1447197 | A2 | 8/2004 |
| EP | 1447197 | B1 | 6/2007 |
| GB | 954390 | A | 4/1964 |

OTHER PUBLICATIONS

State Intellectual Property Office of the P.R.C., Office Action in Chinese Patent Application No. 201110292602.5, mailed Sep. 4, 2013.

* cited by examiner

*Primary Examiner* — James Sanders
*Assistant Examiner* — Kimberly A Stewart
(74) *Attorney, Agent, or Firm* — Ingrassia Fisher & Lorenz, P.C.

(57) ABSTRACT

Embodiments of a mold insert assembly and methods of use are disclosed herein. A mold insert assembly includes, but is not limited to a driving member that moves between a retracting position and an extending position, a plurality of first-segment members engaging the driving member and moving between a first retracted position and a first extended position and a plurality of second-segment members proximate the plurality of first-segment members and configured to move between a second retracted position and a second extended position as the driving member moves to the extending position. The plurality of first-segment members and second-segment members cooperate to form a substantially liquid-tight periphery when the driving member is in the extending position. The plurality of first-segment members second-segment members are configured to move towards the first and second retracted positions, respectively when the driving member moves towards the retracting position.

14 Claims, 13 Drawing Sheets

MOLD INSERT ASSEMBLY AND METHOD OF USE

TECHNICAL FIELD

The technical field generally relates to molding, and more particularly relates to a mold insert assembly and a method of use.

BACKGROUND

Molding articles of manufacture through the use of various molding techniques such as die casting and sand casting are well known. These techniques generally entail heating a metal material to a temperature that equals or exceeds its melting point, allowing the metal material to melt into a liquid material, and then pouring the liquid material into a metal or sand mold that has a desired shape to form an article of manufacture. Once the liquid material is in the mold, it is allowed to cool and solidify. Once solidified, the metal material is removed from the mold.

It is common practice to position inserts referred to as cores in sand casting into the mold during the molding process to form cavities in the metal material as it solidifies. For example, when forming an engine block for an automobile engine, it is common to position inserts into the mold at locations where the engine's cylinders will be located. This obviates the need to bore material out of an otherwise solid engine block.

When certain metal alloys are molded in the manner described above, it is sometimes desirable to accelerate the cooling process. For example, when forming an engine block from an aluminum alloy, it may be desirable to cool the molten aluminum alloy in the immediate vicinity of the cylinder cavities as quickly as possible. This accelerated cooling will yield cylinder bores having wear properties that are superior to cylinder bores of aluminum alloy engine blocks that are cooled more slowly.

To accelerate the cooling of the metal alloy in the vicinity of a cavity, the insert that is used to form the cavity is conventionally made of metal. Because of the ability of metal to conduct heat, the presence of the metal insert in the molten metal material draws heat out of the molten material causing it to cool more quickly. Such a metal insert is commonly referred to as a "chill". As the molten metal material cools and solidifies, it contracts around the chill, making it difficult to remove the chill from the solid metal material. Frequently, a high degree of force is required to extract the chill from the solidified metal material. As a result, after repeated use, the chill can become scored or otherwise damaged and may need to be replaced. Also scoring of the bores or block distortion may result from this force.

In the die casting process, the metal tooling acts as the chill. However because of the contraction of the cast metal onto the die tooling, the block becomes difficult to remove from the die, resulting in tool wear, block distortion and damage to the casting bore surface. Excess draft is added to the tool to help removal but this generally requires additional machining after the casting has hardened to compensate for the draft. This, in turn, adds costs and may adversely affect the properties of the final bore surface structure.

SUMMARY

Various embodiments of a mold insert assembly and a method of using a mold insert assembly having a plurality of segment members that are configured to cooperate to form a substantially liquid-tight outer periphery and further configured to selectively collapse, are disclosed herein.

In an embodiment, the mold insert assembly includes, but is not limited to, a first driving member that is configured to move between a retracting position and an extending position. The mold insert assembly further includes a plurality of first-segment members positioned to engage the first driving member and configured to move between a first retracted position and a first extended position when the first driving member moves between the retracting position and the extending position, respectively. The mold insert assembly further includes a plurality of second-segment members disposed proximate the plurality of first-segment members and configured to move between a second retracted position and a second extended position when the first driving member moves between the retracting position and the extending position, respectively. The plurality of first-segment members and the plurality of second-segment members cooperate to form a substantially liquid-tight periphery when the first driving member is in the extending position. The plurality of first-segment members and the plurality of second-segment members are configured to move towards the first retracted position and the second retracted position, respectively when the first driving member moves towards the retracting position.

In another embodiment, the mold insert assembly includes, but is not limited to, a first driving member that is configured to rotate between a retracting position and an extending position. The mold insert assembly further includes a plurality of first-segment members engaging the first driving member and configured to move between a first retracted position and a first extended position when the first driving member rotates between the retracting position and the extending position, respectively. The mold insert assembly further includes a plurality of second-segment members engaging the first driving member and configured to move between a second retracted position and a second extended position when the first driving member rotates between the retracting position and the extending position, respectively. The plurality of first-segment members and the plurality of second-segment members cooperate to form a substantially liquid-tight periphery when the first driving member is in the extending position. The plurality of first-segment members and the plurality of second-segment members are configured to move towards the first retracted position and the second retracted position, respectively when the first driving member rotates towards the retracting position.

In another embodiment, the method includes, but is not limited to inserting the mold insert assembly into a mold, positioning the plurality of segment members to form the substantially liquid-tight outer periphery, introducing a liquid material into the mold, cooling the liquid material until the liquid material becomes a solid material, collapsing the plurality of segment members, and removing the mold insert assembly from the solid material.

DESCRIPTION OF THE DRAWINGS

One or more embodiments will hereinafter be described in conjunction with the following drawing figures, wherein like numerals denote like elements.

DETAILED DESCRIPTION

Figure 1:
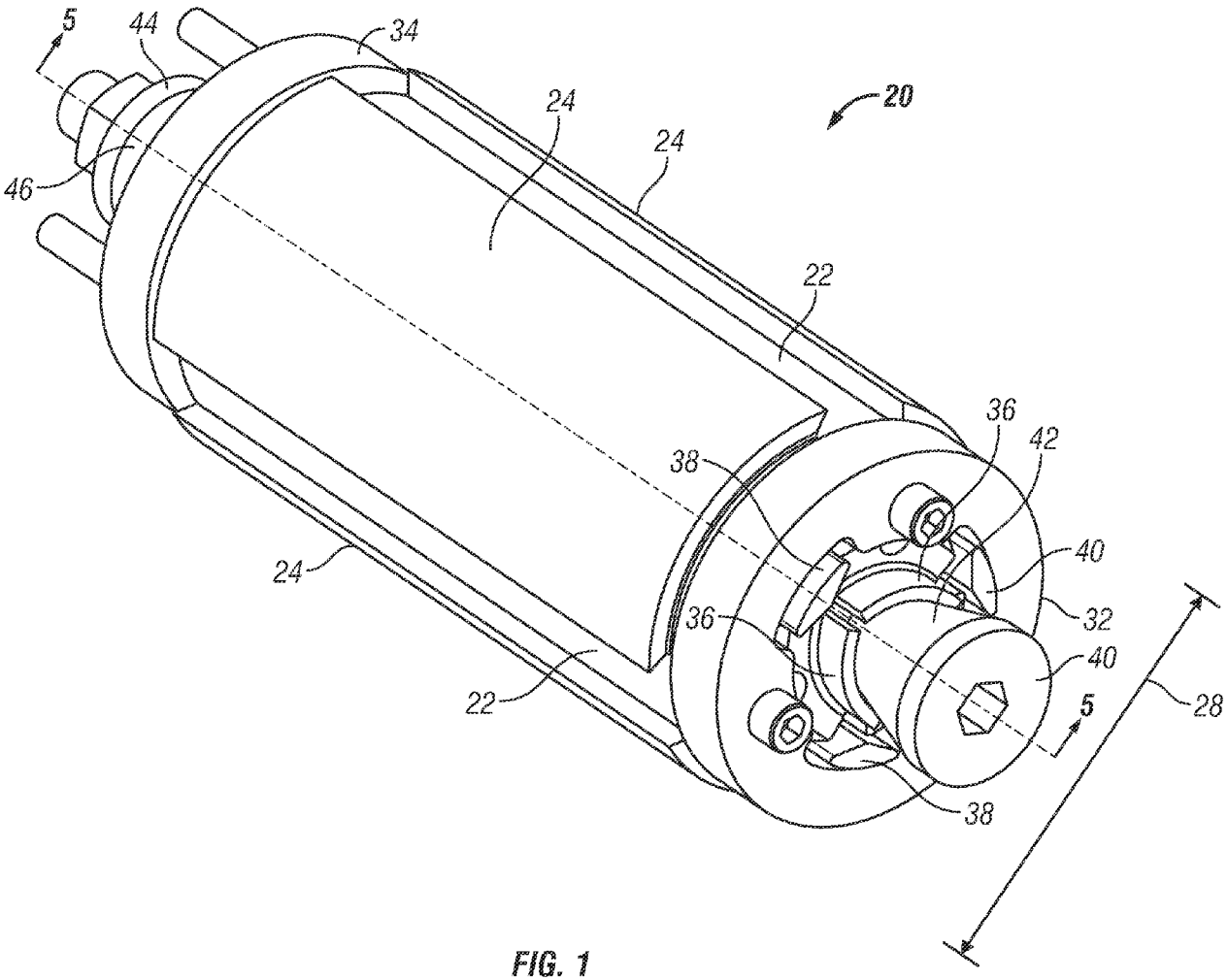
FIG. 1 is a perspective view of an embodiment of a mold insert assembly made in accordance with the teachings of the present disclosure while the mold insert assembly is in a collapsed state.

The following detailed description is merely exemplary in nature and is not intended to limit application and uses. Furthermore, there is no intention to be bound by any expressed or implied theory presented in the preceding technical field, background, brief summary or the following detailed description.

An improved mold insert assembly and a method of using the mold insert assembly are disclosed herein. The mold insert assembly includes multiple segment members that are designed to move between retracted positions and extended positions. When the multiple segment members are in their retracted positions, they form a periphery that is smaller than the periphery they form when they are in their extended positions. When the multiple segment members are in their retracted positions, the mold insert assembly will be referred to as being in a collapsed state. When the multiple segment members are in their extended positions, the mold insert assembly will be referred to as being in an expanded state. When the multiple segment members are in the extended position, they are arranged and aligned with one another such that they cooperate to form a substantially liquid-tight periphery. This inhibits any liquid material from permeating the mold insert assembly.

A driving member is configured to move between a retracting position and an extending position. The driving member engages some or all of the multiple segment members and moves them from their retracted positions to their extended positions when the driving member moves from the retracting position to the extending position. This can be accomplished in many ways including, but not limited to, through linear motion and engagement between camming surfaces, and/or through rotational motion and engagement between threaded surfaces.

When the driving member moves from the extending position back to the retracting position, the multiple segment members are free to move back to their retracted positions. In some embodiments, the movement of the driving member from the extending position to the retracting position will cause the multiple segment members to move back to their retracted positions. In other embodiments, additional mechanisms may be required to move the multiple segment members back to their retracted position.

By forming a substantially liquid-tight periphery when the multiple segment members are in their extended position, it is possible to use the mold insert assembly as a chill to draw heat away from a liquid material such as a molten metal poured into a mold. By moving the multiple segment members from their extended positions to their retracted positions, the periphery of the mold insert assembly can be reduced in size and can therefore be easily removed from the solidified metal material without excessive effort and without damaging either the mold insert assembly or the solidified metal material.

A further understanding of the mold insert assembly and methods for using the mold insert assembly may be obtained through a review of the illustrations accompanying this application together with a review of the detailed description that follows.

FIG. 1 is a perspective view of an embodiment of a mold insert assembly 20 while in a collapsed state. Mold insert assembly 20 is generally cylindrical and has a generally circular cross section making it useful for forming a circular cylindrical cavity in a metal casting. One potential use for mold insert assembly 20 would be to form a bore in an engine block, such bore being configured to receive a cylinder. Mold insert assembly 20 may also be utilized in any other application where it is desirable to form a generally circular cylindrical cavity in a metal casting. All insert assembly 20 is illustrated as a cylinder having a circular cross section, it should be understood that any desired or suitable geometrical configuration may be employed. For example, mold insert assembly 20 may have a square shaped cross-section, a rectangular shaped cross-section, a hexagonal shaped cross-section, an elliptical cross section, etc.

Figure 2:
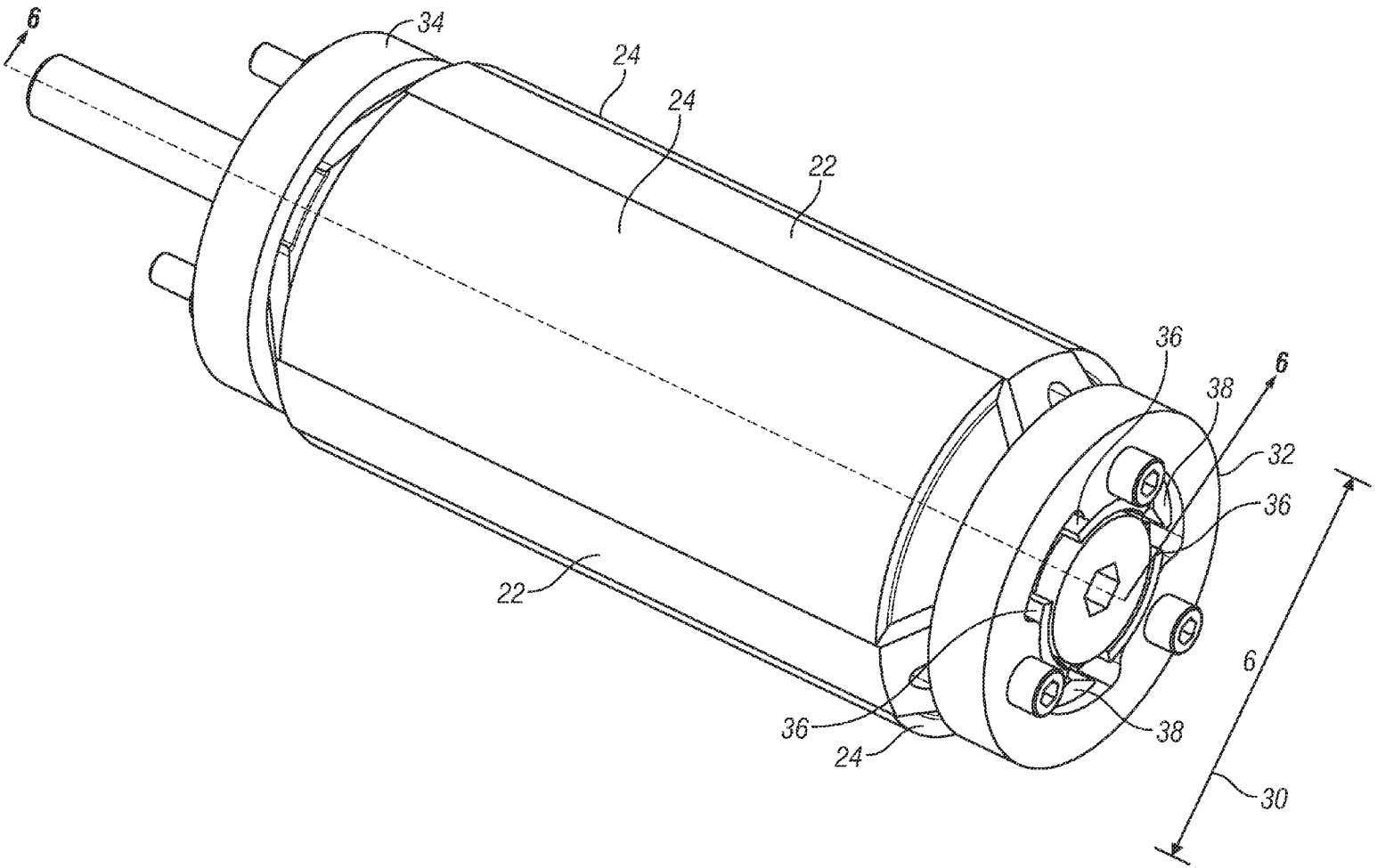
FIG. 2 is a perspective view of the mold insert assembly of FIG. 1 while in an expanded state.

FIG. 2 is a perspective view of mold insert assembly 20 while in an expanded state. With continuing reference to FIGS. 1 and 2, mold insert assembly 20 includes a plurality of first-segment members 22 and a plurality of second-segment members 24. First-segment members 22 are each configured to move between a first retracted position (illustrated in FIG. 1) and a first extended position (illustrated in FIG. 2). Similarly, second-segment members 24 are each configured to move between a second retracted position (illustrated in FIG. 1) and a second extended position (illustrated in FIG. 2).

When mold insert assembly 20 is in the collapsed state, as illustrated in FIG. 1, it has a periphery having a diameter 28. When mold insert assembly 20 is in the expanded state, as illustrated in FIG. 2, it has a periphery having a diameter 30. Diameter 30 is larger than diameter 28, which makes it possible to easily remove mold insert assembly 20 from the solid metal casting after it has cooled.

A collar member 32 and a collar member 34 are positioned at opposite longitudinal ends of mold insert assembly 20. Collar members 32 and 34 and configured to constrain outward movement of first-segment members 22 and second-segment members 24 beyond their respective extended positions. First-segment members 22 each include a first tab 36 disposed at their longitudinal ends that are configured to engage collar member 32 and to cooperate with collar member 32 to inhibit first-segment member from moving beyond its extended position. In some embodiments, first-segment members 22 may include an additional set of first tabs at their opposite longitudinal ends to engage and to cooperate with collar member 34 to inhibit outward movement beyond the extended positions of first-segment members 22. Although the embodiment of mold insert assembly 20 illustrated in FIGS. 1 and 2 include collar members 32 and 34, it should be understood that collar members 32 and 34 need not be a part of mold insert assembly 20. Rather, collar members 32 and 34, or other similar components may be part of the tooling that positions, actuates, controls, and/or removes mold insert assembly 20 during a molding process.

Second-segment members 24 each include a second tab 38 at their longitudinal ends. Second tabs 38 are configured to engage collar member 32 and to cooperate with collar member 32 to inhibit second-segment members 24 from moving outwardly beyond their extended positions. In some embodiments, second-segment members 24 may include an additional set of second tabs 38 at their opposite longitudinal ends to engage and to cooperate with collar member 34 to inhibit outward movement of second-segment members 24 beyond their extended positions.

A driving member 40 is positioned proximate the longitudinal ends of first-segment members 22 and second-segment members 24. In the illustrated embodiment, driving member 40 has a generally truncated conical shape. Other configurations may also be used. A side 42 of driving member 40 is canted at an oblique angle with respect to its direction of motion towards the first-segment members 22. In the illustrated example, a second driving member, driving member 44 is disposed at an opposite end of mold insert assembly 20. Driving member 44 is similarly configured as a truncated cone and side 46 is canted at an oblique angle with respect to its direction of motion towards first-segment members with respect to first-segment members 22.

Driving member 40 and driving member 44 are configured to move inwardly towards one another from a retracting position (illustrated in FIG. 1) to an extending position (illustrated in FIG. 2). In some embodiments, such movement may be accomplished through the use of a threaded rod having oppositely oriented threads at opposite ends of the rod. The threads on the rod may engage with threads defined on an internal bore defined in driving members 40 and 44. Rotation of the rod will cause driving members 40 and 44 to move inwardly or outwardly in a linear manner depending upon the direction of rotation. In the embodiment illustrated in FIG. 2, linking member 49 is integral with driving member 44 and in threaded engagement with driving member 40. As driving member 44 is rotated, driving member 44 and a driving member 40 are moved closer together or further apart depending upon the direction of rotation.

When driving member 40 and driving member 44 are in their retracting positions, first-segment members 22 and second-segment members 24 are free to occupy their respective retracted positions. When driving members 40 and 44 move towards one another, sides 42 and 46 engage first-segment members 22, and act as a camming surface that drives first-segment members in an outward direction from their retracted positions towards their extended positions. As described below, outward movement of first-segment members 22 causes second-segment members 24 to also move in an outward direction towards their extended positions Such outward movement will continue as driving members 40 and 44 continue moving towards one another until first tabs 36 and second tabs 38 are obstructed from further outward movement by collar member 32.

Figure 3:
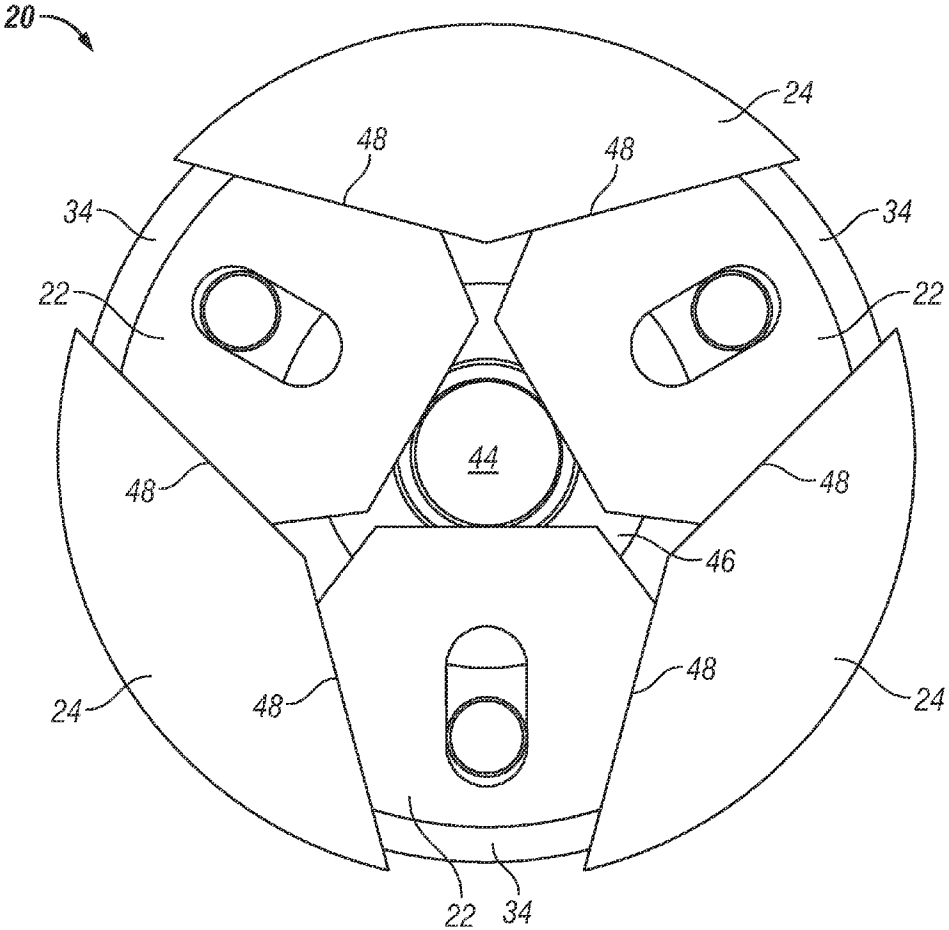
FIG. 3 is an axial view of the mold insert assembly of FIG. 1 while in the collapsed state.
Figure 4:
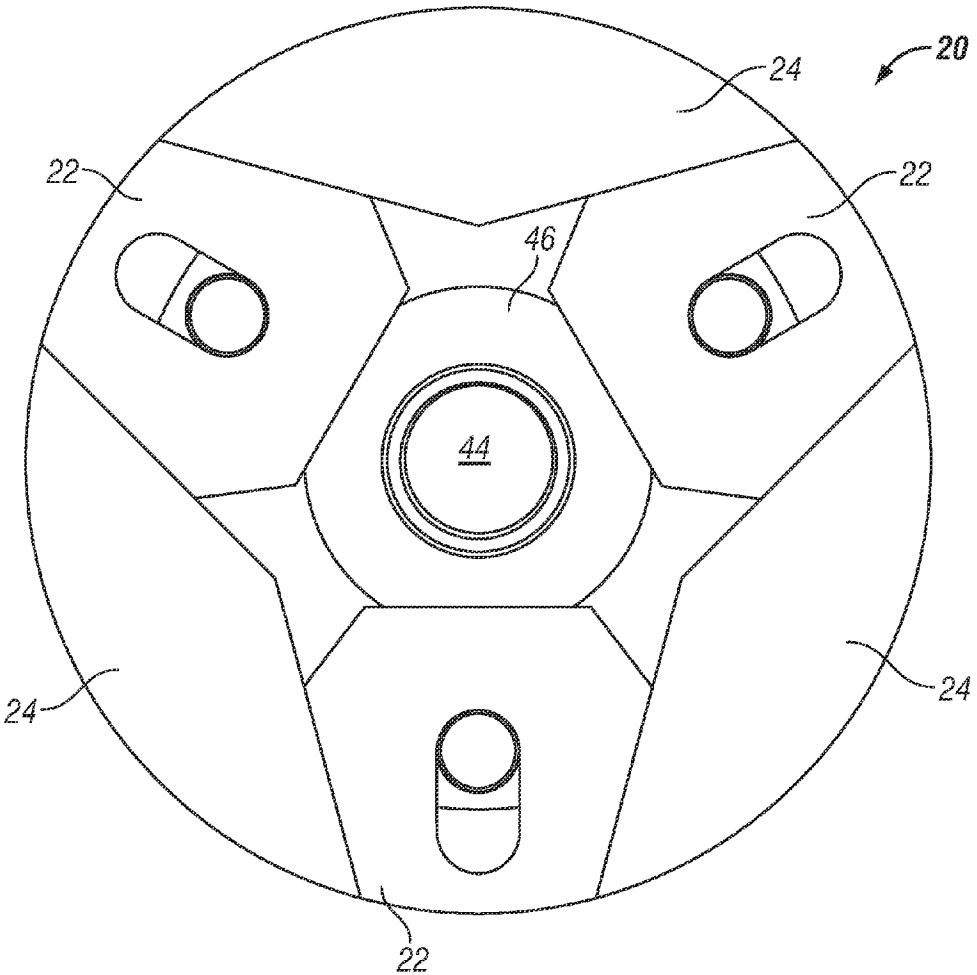
FIG. 4 is an axial view of the mold insert assembly of FIG. 2 while in the expanded state.

FIG. 3 is an axial view of mold insert assembly 20 while in the collapsed state and FIG. 4 is an axial view of mold insert assembly 20 while in the expanded state. With continuing reference to FIGS. 1-4, FIGS. 3 and 4 present axial views of mold insert assembly 20 looking in the direction from driving member 40 towards driving member 44, with driving member 40, collar member 32, first tabs 36 and second tabs 38 omitted for the sake of simplification.

FIGS. 3 and 4 illustrate the engagement that occurs between first-segment members 22 and second-segment members 24 as driving members 40 and 44 move towards one another. In FIG. 3, first-segment members 22 and second-segment members 24 are in their respective retracted positions. Driving members 40 and 44 are in their respective retracting positions and are positioned adjacent to first-segment members 22. As driving members 40 and 44 move towards one another, they will urge first-segment members 22 in an outward direction. As first-segment members 22 move outwardly, their sides 48 will act as a camming surface that urges second-segment members 24 to also move in an outward direction FIG. 4 illustrates mold insert assembly 20 in the expanded state with first-segment members 22 and second-segment members 24 forming a substantially liquid-tight periphery. As used herein, the term "liquid-tight" is intended to mean inhibiting the permeation of liquid. The angle at which each side 48 of each first-segment member 22 is canted corresponds to the angle of the sides of each second-segment member 24. Thus, in the illustrated embodiment, substantial portions of each first-segment member 22 remain in direct contact with substantial portions of each second-segment member 24 as mold insert assembly 20 goes from the collapsed to the expanded state. This direct contact contributes to the creation of a liquid-tight arrangement between first-segment members 22 and second-segment members 24 when mold insert assembly 20 is in the expanded state.

Figure 5:
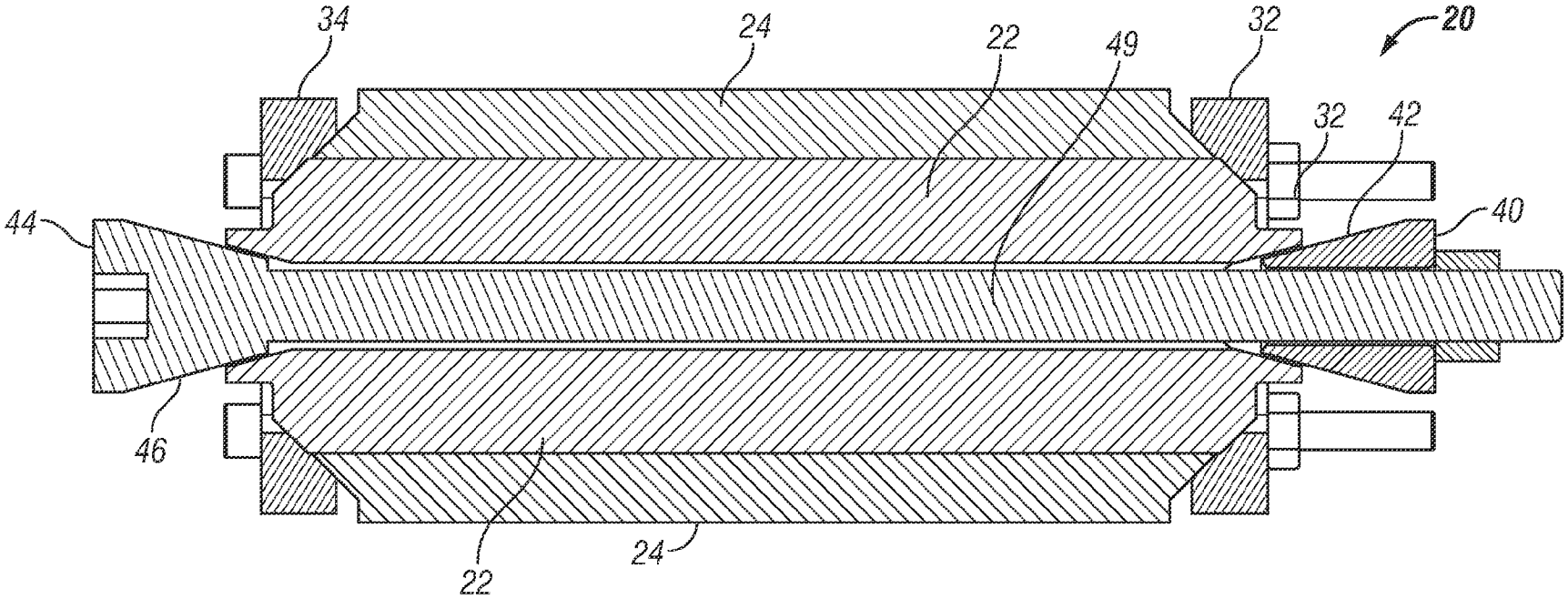
FIG. 5 is a cross sectional view of the mold insert assembly of FIG. 1 taken along the line 5-5 while the mold insert assembly is in the collapsed state.
Figure 6:
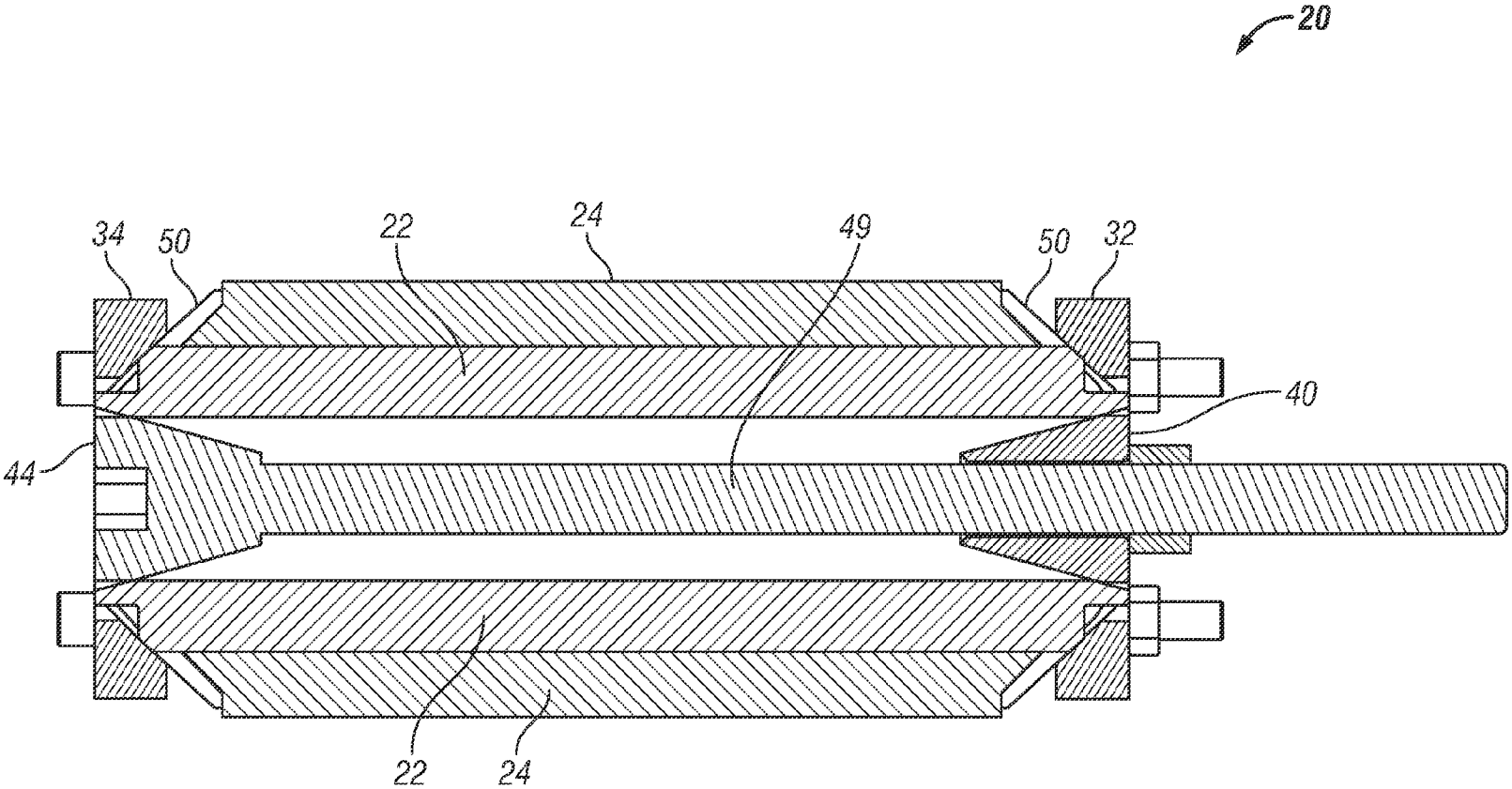
FIG. 6 is a cross sectional view of the mold insert assembly of FIG. 2 taken along the line 6-6 while the mold insert assembly is in the expanded state.

FIG. 5 is a cross sectional view of mold insert assembly 20 taken along the line 5-5 of FIG. 1 while the mold insert assembly is in the collapsed state and FIG. 6 is a cross sectional view of mold insert assembly 20 taken along the line 6-6 of FIG. 2 while the mold insert assembly is in the expanded state. FIGS. 5 and 6 each illustrate a linking member 49 that connects driving member 40 to driving member 44. As discussed above, in some embodiments, linking member 49 may comprise a threaded rod having oppositely oriented threads disposed at opposite ends of linking member 49 such that rotation of linking member 49 would cause linear movement of driving members 40 and 44 towards and away from one another.

FIGS. 5 and 6 also illustrate the linear movement of driving members 40 and 44 towards one another and show how driving members 40 and 44 act as a wedge that drives first-segment members 22 in an outward direction.

Once driving members 40 and 44 are retracted, mold insert assembly 20 is able to return to the collapsed state as a result of the urging exerted by the contracting forces of the metal casting and an added force preferentially applied to the first segment members. Mold insert assembly 20 is configured to cause such collapse. This configuration is illustrated in FIG. 6.

In the illustrated embodiment, first-segment members 22 are longer than second-segment members 24. As a result, a first-segment-member camming surface 50, which is disposed at each opposite longitudinal end of each first-segment member 22, extends beyond the longitudinal ends of second-segment members 24, as best seen in FIG. 6. Because of their protrusion beyond the longitudinal ends of second-segment members 24, each first-segment-member camming surface 50 is disposed proximate to collar members 32 and 34 and each is configured to engage with collar members 32 and 34. When collar members 32 and 34 are moved towards one another, collar member 32 will engage with first-segment-member-camming surface 50 to urge first-segment members 22 towards their retracted positions (this is an example of the added force described in the preceding paragraph). Such urging by collar members 32 and 34 of first-segment members 22 cause mold insert assembly 20 to collapse, permitting mold insert assembly 20 to be removed from the metal casting. Once first segment members move toward their retracted positions, a gap is created between first-segment members 22 and second-segment members 24 and the contraction stresses of the casting will move second-segment members 24 in.

Figure 7:
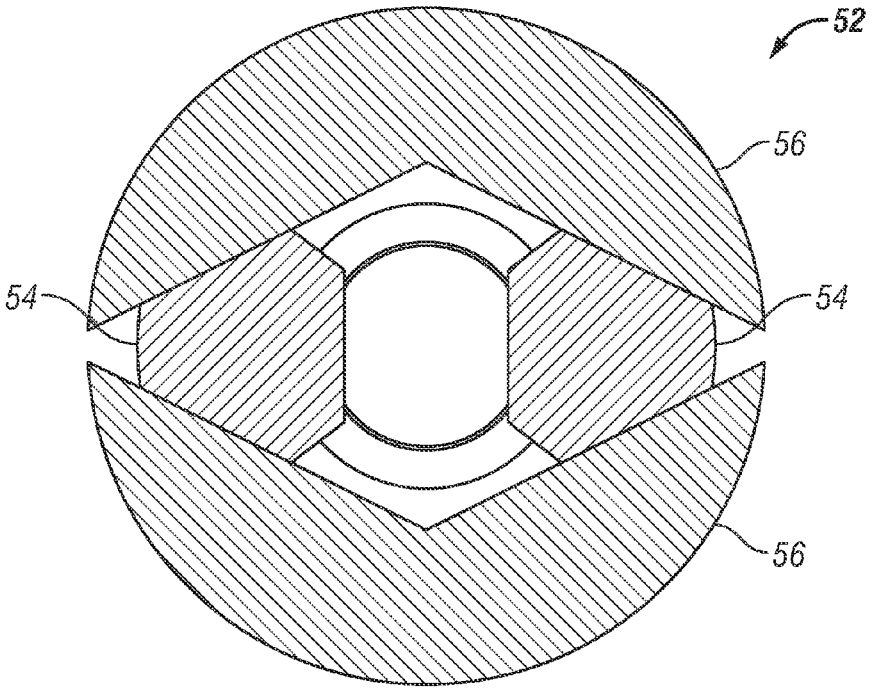
FIG. 7 is an axial view of an alternate embodiment of a mold insert assembly made in accordance with the teachings of the present disclosure while the mold insert assembly is in the collapsed state.
Figure 8:
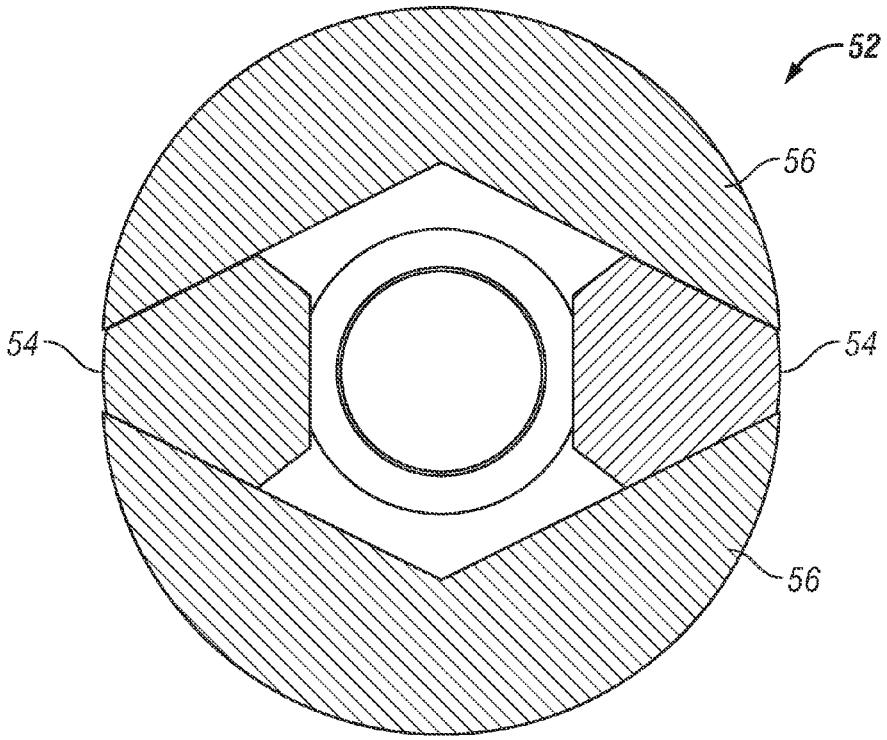
FIG. 8 is an axial view of the mold insert assembly of FIG. 7 while the mold insert assembly in the expanded state.

FIG. 7 is an axial view of an alternate embodiment of a mold insert assembly 52 while in the collapsed state and FIG. 8 is an axial view of mold insert assembly 52 while in the expanded state. With continuing reference to FIGS. 1-8, mold insert assembly 52 includes a pair of first-segment members 54 and a pair of second-segment members 56. First-segment members 54 and second-segment members 56 are analogous to first-segment members 22 and second-segment members 24 described above. Mold insert assembly 52 operates in substantially the same manner as that described above with respect to mold insert assembly 20. FIGS. 7 and 8 are provided here for the purpose of illustrating a configuration that permits a mold insert assembly to collapse and to expand with only two segment members in each group of segment members. It should be understood that the number of segments in each group may vary from two as the minimum to as many as desired. However, each group of segment members will have the same number of segment members.

Segment members in a group do not need to be identical and the angles of their respective edges need not to be symmetrical. However, when different angles are employed, the angle of the neighboring segment will need to be complementary to maintain direct contact between the segments across substantially the entire surface of their respective edges, and thereby maintain liquid tightness. Additionally, the segment members need not be concentrically placed around an axis. Asymmetric arrangements are possible and, depending upon the application, may be desirable.

Figure 9:
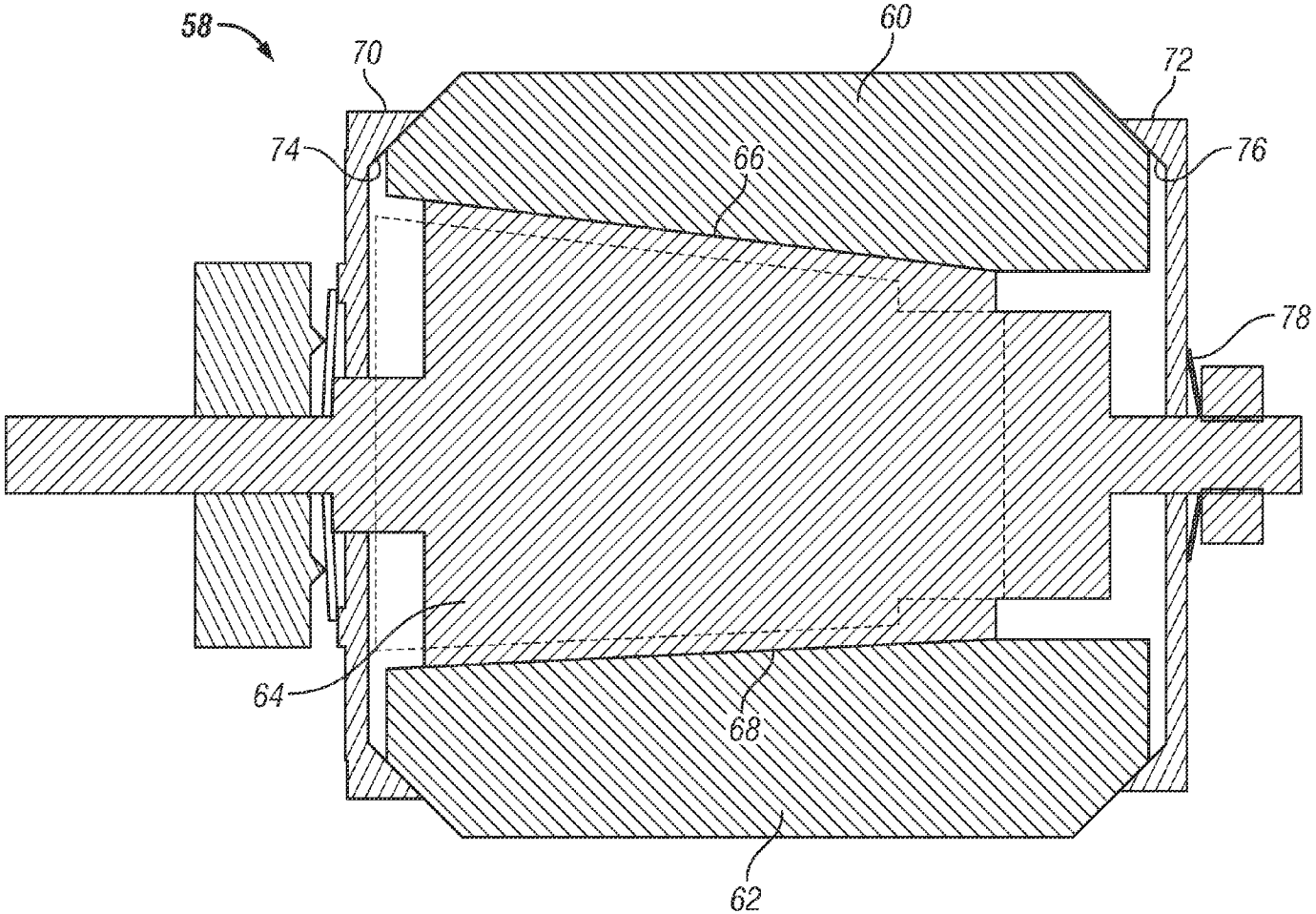
FIG. 9 is a cross sectional view of another embodiment of a mold insert assembly made in accordance with the teachings of the present disclosure.
Figure 10:
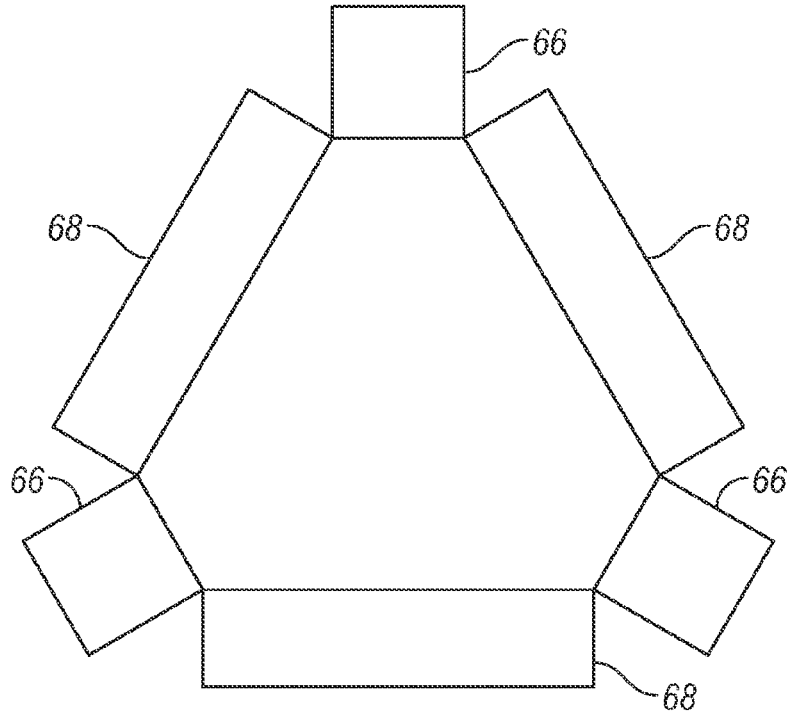
FIG. 10 is an axial view of a driving member for use with the mold insert assembly of FIG. 9.

FIG. 9 is a cross sectional view of another embodiment of a mold insert assembly 58 made in accordance with the teachings of the present disclosure. FIG. 10 is an axial view of a driving member 64 for use with mold insert assembly 58. FIG. 10 may look more like a long bevel gear, with few teeth. However, the root of the tooth angle will be more or less than the crest of the tooth depending on which segment member is to be the fast mover and which segment member is to be the slow mover. In some embodiments, the tooth spacing may not be equal.

Figure 11:
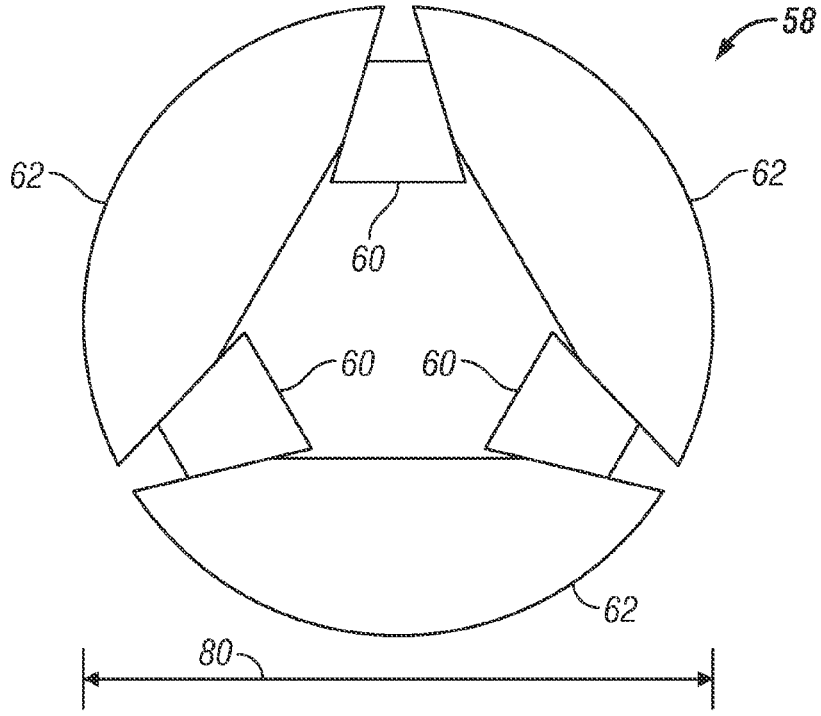
FIG. 11 is an axial view of the mold insert assembly of FIG. 9 while the mold insert assembly is in a collapsed state.
Figure 12:
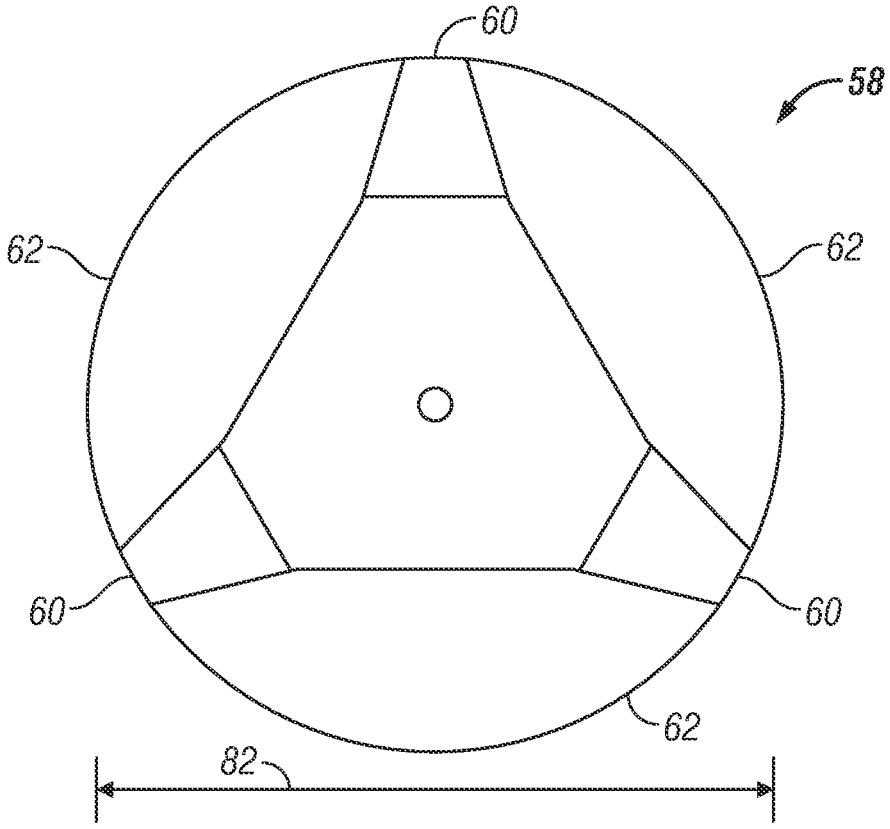
FIG. 12 is an axial view of the mold insert assembly of FIG. 9 while the mold insert assembly is in an expanded state.

FIG. 11 is an axial view of mold insert assembly 58 while in a collapsed state and FIG. 12 is an axial view of mold insert assembly 59 while in an expanded state. With continuing reference to FIGS. 9-12, mold insert assembly 58 includes a plurality of first-segment members 60, a plurality of second-segment members 62, and driving member 64. Driving member 64 has a plurality of first beveled surfaces 66 and a plurality of second beveled surface 68 and is configured to move between an extending position (illustrated in solid lines) and a retracting position (illustrated in phantom lines). As best seen in FIG. 9, first beveled surface 66 and second beveled surface 68 are beveled at different angles, with first beveled surface 66 having a steeper grade than second beveled surface 68. This difference in grade between the differing beveled surfaces results in a different rate and distance of movement for first-segment members 60 and second-segment members 62 as they move between their respective retracted and extended positions.

Driving member 64 is configured to move in a linear manner between a retracting position and an extending position. First and second beveled surfaces 66 and 68 are configured to engage first-segment members and second-segment members 60 and 62, respectively as driving member 64 moves from the retracting position to the extending position. First and second beveled surfaces 66 and 68 act as camming surfaces that drive first-segment members 60 and second-segment members 62 in an outward direction.

In FIG. 9, driving member 64 is illustrated in the extending position and the plurality of first-segment members 60 and the plurality of second-segment members 62 are in their respective extended positions, forming a substantially liquid-tight periphery, as best seen in FIG. 12.

A first collar member 70 and a second collar member 72 are illustrated in FIG. 9. First collar member 70 and second collar member 72 have a first camming surface 74 and a second camming surface 76, respectively that are positioned to engage plurality of first-segment members 60 and plurality of second-segment members 62 proximate their respective longitudinal ends. As driving member 64 moves to the extending position, plurality of first-segment members 60 and plurality of second-segment members 62 are obstructed from continued outward expansion via engagement with first camming surface 74 and second camming surface 76.

Once driving member 64 is pulled back to its retracting position, plurality of first-segment members 60 and plurality of second-segment members 62 are free to collapse back to their respective retracted positions. In some embodiments, to ensure that such collapse occurs, a spring member 78 may be provided to exert a biasing force on second collar member 72. Such biasing force urges second collar member 72 towards first collar member 70. As second collar member 72 is urged towards first collar member 70, first camming surface 74 and second camming surface 76 engage with plurality of first-segment members 60 and second-segment members 62, urging them to collapse inwardly.

FIGS. 11 and 12 are axial views of mold insert assembly 58 while in the collapsed state and the expanded state, respectively. These views are illustrated from the perspective of looking in the direction from second collar member 72 towards first collar member 70, with first and second collar members 70 and 72 and with driving member 64 omitted for the sake of simplification. When in the collapsed state, mold insert assembly 58 has a periphery having a diameter 80. When in the expanded state, mold insert assembly 58 has a diameter 82. Diameter 82 is larger than diameter 80. This difference in the size of the respective diameters is what permits mold insert assembly 58 to be easily removed from the solidified metal casting after it has cooled.

Figure 13:
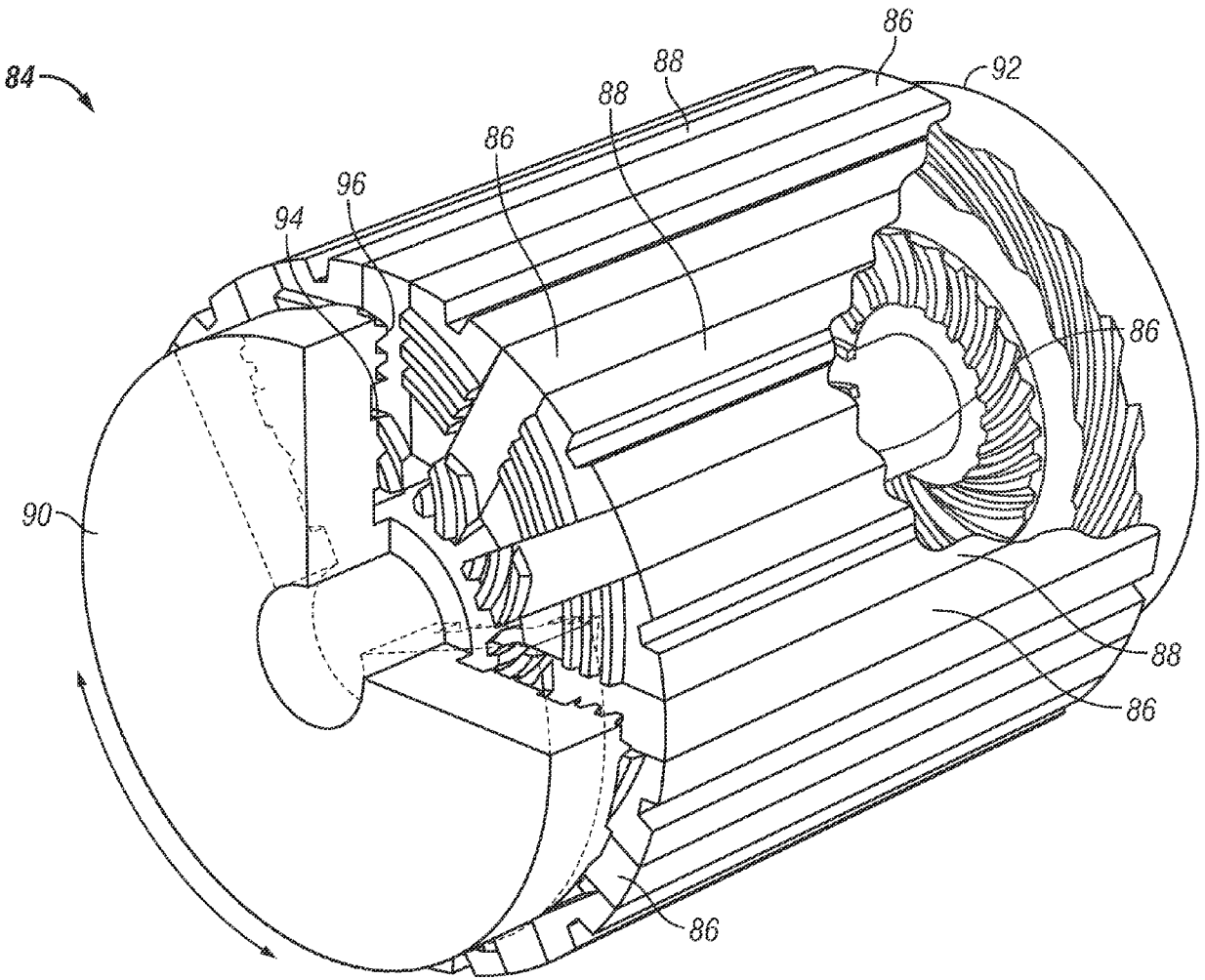
FIG. 13 is a perspective view of still another embodiment of a mold insert assembly made in accordance with the teachings of the present disclosure.

FIG. 13 is a perspective view of still another embodiment of a mold insert assembly 84 made in accordance with the teachings of the present disclosure. Mold insert assembly 84 includes a plurality of first-segment members 86, a plurality of second-segment members 88, a first driving member 90 and a second driving member 92. First and second driving members 90 and 92 are connected to one another and are configured to rotate in unison between a retracting position (shown in phantom lines) and an extending position (shown in solid lines). First and second driving members 90 and 92 are in threaded engagement with plurality of first-segment members 86 and second-segment members 88. First-segment members 86 and second-segment members 88 are configured to move between a retracted position and an extended position as first and second driving members 90 and 92 move between their retracting position and their extending position. When in their respective extended positions, first-segment members 86 and second-segment members 88 cooperate to form a substantially liquid-tight periphery.

In the illustrated embodiment, because of their respective shapes, first-segment members 86 must retract from their extended positions more rapidly that second-segment members 88 in order to provide clearance for second-segment members 88 to retract. To achieve different rates of movement, different threading is used to control the movement of first-segment members 86 and second-segment members 88. A first set of threads 94, disposed on an internally facing surface of first and second driving members 90 and 92 is used to control the movement of first-segment members 86. A second set of threads 96, arranged concentrically with first set of threads 94, is used to control second-segment members 88. First-segment members 86 have threads located at their longitudinal ends that are configured to engage first set of threads 94 and second-segment members 88 have threads located at their longitudinal ends that are configured to engage second set of threads 96. To ensure that first-segment members 86 and second-segment member 88 move at different rates, first set of threads 94 has a coarser pitch than second set of threads 96. This coarser pitch causes first-segment members 86 to move more rapidly than second-segment members 88 as first and second driving members 90 and 92 rotates between their retracting and extending positions.

Figure 14:
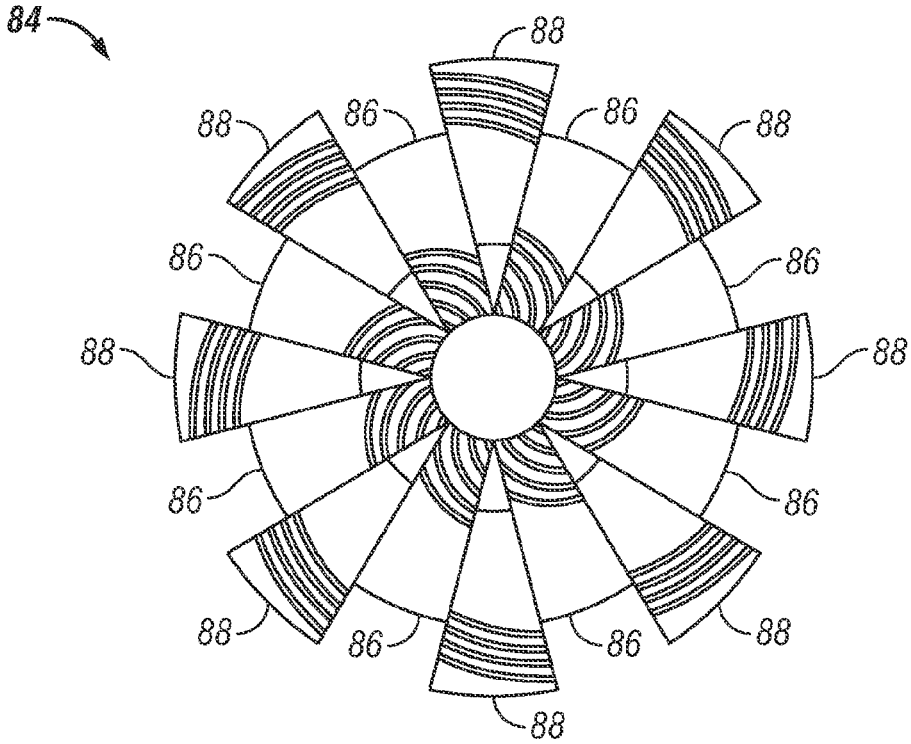
FIG. 14 is an axial view of the mold insert assembly of FIG. 13 while the mold insert assembly is in a collapsed state.

FIG. 14 is an axial view of mold insert assembly 84 while the mold insert assembly is in a collapsed state. In this view, first-segment members 86 and second-segment members 88 are disposed in their respective retracted positions. In this view, the difference in pitch between the threading disposed on the longitudinal ends of first-segment members 86 and second-segment members 88 is clearly visible (the difference in pitch has been exaggerated for ease of illustration)

Figure 15:
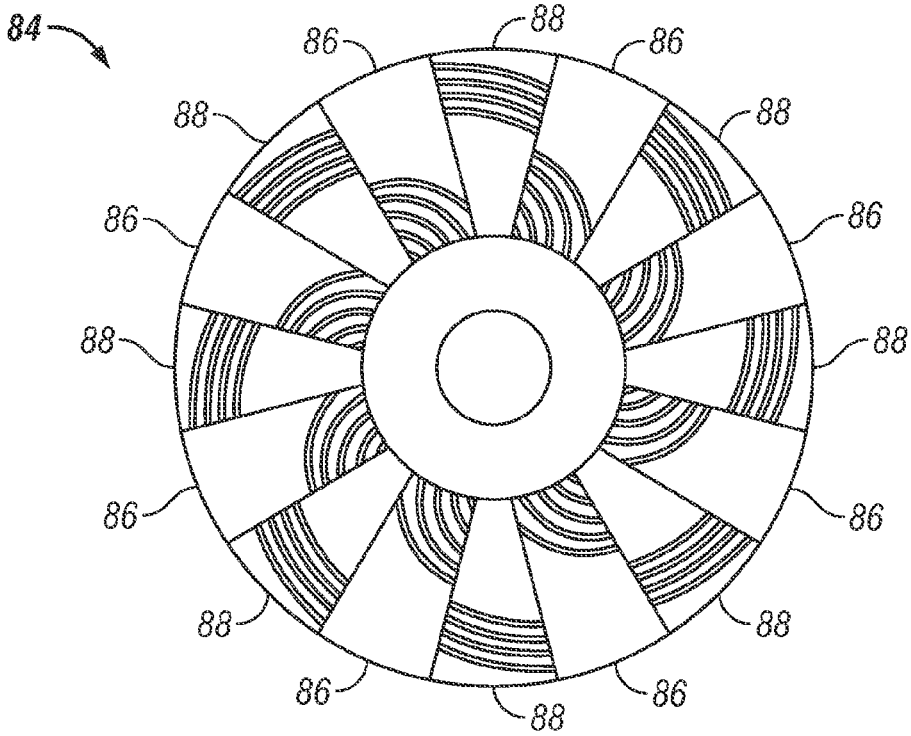
FIG. 15 is an axial view of the mold insert assembly of FIG. 13 while the mold insert assembly is in an expanded state.

FIG. 15 is an axial view of the mold insert assembly of FIG. 13 while the mold insert assembly is in an expanded state. In this view, first-segment members 86 and second-segment members 88 are in their respective extended positions. As illustrated in this figure, first-segment members 86 and second-segment members 88 cooperate to form a substantially liquid-tight periphery.

Figure 16:
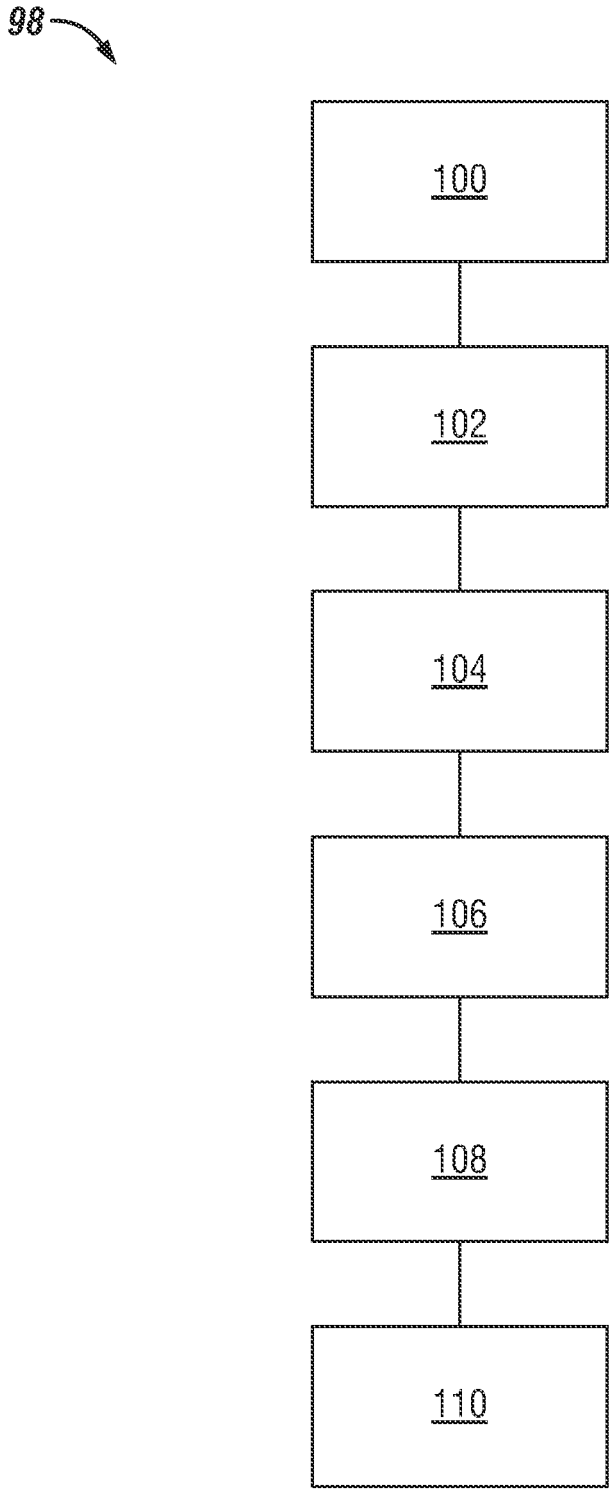
FIG. 16 is a flow diagram illustrating a method for using a collapsible mold insert assembly.

FIG. 16 is a flow diagram illustrating a method 98 for using a collapsible mold insert assembly. The components of the collapsible mold insert assembly include a plurality of segment members that are configured to move between retracted and extended positions and a driving member that is configured to move the segment members between their retracted and extended positions. The plurality of segment members are configured to cooperate to form a substantially liquid-tight outer periphery when in their extended positions and the mold insert assembly is configured to be selectively collapsed.

At block 100, the mold insert assembly is inserted into a mold cavity. The mold insert assembly should be positioned at a location corresponding to a location on the finished metal casting where it is desirable to form a cavity. In some embodiments, the mold insert assembly will be connected to the tool face and positioned in the mold cavity when the mold closes. In such embodiments, the mold insert assembly will expand as a result of the closure of the mold. Conversely, the opening of the mold will cause collapse of the mold insert assembly.

At block 102, the plurality of segment members are positioned in their extended position to form the substantially liquid-tight outer periphery. The presence of a liquid-tight periphery will inhibit any liquid material from entering the mold insert assembly during the molding process. When the plurality of segment members are positioned in their extended positions, the mold insert assembly is in its expanded state and has an outer periphery that is larger than its periphery while in the collapsed state.

At block 104, a liquid material is introduced into the mold. The liquid material fills in the vacant space in the mold and does not penetrate the area occupied by the mold insert assembly.

At block 106, the liquid material is allowed to cool. The mold insert assembly facilitates cooling by acting as a heat sink, drawing heat away from the liquid material. In some examples, the mold insert assembly may have water or oil cooling lines inside of it to further accelerate the cooling process. Once cooled, the material solidifies.

At block 108, the plurality of segment members are collapsed. This may be accomplished by retracting a driving member. In some embodiments, further actuation may be required to collapse the plurality of segment members in addition to retracting the driving member.

At block 110, the mold insert assembly is removed from the solidified material, leaving a cavity in the solidified material that corresponds to the shape of the mold insert assembly.

Although the preceding discussion has been presented in the context of metal casting, it should be understood that the principles discussed above as well as the various embodiments of the collapsible mold insert assembly and the method for using a collapsible mold insert assembly are equally applicable to, and may be used in conjunction with the molding of other materials including, but not limited to plastics. For example, the apparatuses and methods discussed above may be used in thermoplastic injection molding manufacture where a thermoplastic is melted and injected into a mold and allowed to cool. The forces of injection and contraction during cooling causes the plastic to be tight on a mandrel and so use of a collapsible mold insert assembly in a thermoplastic injection molding manufacture would be advantageous. Also, the collapsible mold insert assembly and methods of use can apply to thermoset molding. In a thermoset molding process, the thermoset material, prior to curing, is a liquid material. However, with the passage of time, the thermoset material cures and becomes solid. During the curing process, the thermoset material tightens around a mandrel and so use of a collapsible mold insert assembly together with a thermoset molding process would be advantageous.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration in any way. Rather, the foregoing detailed description will provide those skilled in the art with a convenient road map for implementing the exemplary embodiment or exemplary embodiments. It should be understood that various changes can be made in the function and arrangement of elements without departing from the scope as set forth in the appended claims and the legal equivalents thereof.

What is claimed is:

1. A mold insert assembly comprising:

a first driving member configured to move between a retracting position and an extending position;

a plurality of first-segment members positioned to engage the first driving member and configured to move between a first retracted position and a first extended position when the first driving member moves between the retracting position and the extending position, respectively; and a plurality of second-segment members disposed proximate the plurality of first-segment members and configured to move between a second refracted position and a second extended position when the first driving member moves between the retracting position and the extending position, respectively, wherein the plurality of first-segment members and the plurality of second-segment members cooperate to form a substantially liquid-tight periphery when the first driving member is in the extending position and wherein the plurality of first-segment members and the plurality of second-segment members are configured to move towards the first retracted position and the second refracted position, respectively when the first driving member moves towards the retracting position, and wherein each first-segment member has a first longitudinal end having a first configuration, wherein each second-segment member has a second longitudinal end having a second configuration, the second configuration differing from the first configuration in a manner that causes each first-segment member to move towards the first retracted position prior to movement by each second-segment member towards the second retracted position.

2. The mold insert assembly of claim 1, wherein the first driving member moves in a linear manner between the retracting position and the extending position.

3. The mold insert assembly of claim 2, wherein the first driving member includes a driving-member-camming surface, wherein the plurality of first-segment members are disposed adjacent to the driving-member-camming surface and wherein the plurality of second-segment members are disposed adjacent the plurality of first-segment members.

4. The mold insert assembly of claim 2, wherein the plurality of first-segment members and the plurality of second-segment members are arranged in an alternating pattern.

5. The mold insert assembly of claim 2, wherein the plurality of first-segment members includes no more than two first-segment members and wherein the plurality of second-segment members includes no more than two second-segment members.

6. The mold insert assembly of claim 2, wherein the plurality of first-segment members is configured to move the plurality of second-segment members from the second refracted position to the second extended position when the plurality of first-segment members moves from the first retracted position to the first extended position.

7. The mold insert assembly of claim 2, further comprising a second driving member connected to the first driving member via a linking member, wherein the first driving member and the second driving member are disposed at opposite ends of the linking member and wherein the first driving member and the second driving are configured to move towards one another when the first driving member moves from the retracting position to the extending position.

8. The mold insert assembly of claim 2, wherein each first-segment member and each second-segment member are configured to engage a collar member such that the collar member inhibits each first-segment member from moving beyond the first extended position and each second-segment member from moving beyond the second extended position.

9. The mold insert assembly of claim 2, wherein the first driving member has a plurality of first beveled surfaces and a plurality of second beveled surface, wherein the plurality of first beveled surfaces is more steeply angled than the plurality of second beveled surfaces, wherein the plurality of first beveled surfaces engages the plurality of first-segment members as the first driving member moves from the retracting position to the extending position and wherein the plurality of second beveled surfaces engages the plurality of second-segment members as the first driving member moves from the retracting position to the extending position, whereby the first beveled surfaces cause the first-segment members to move between the first retracted position and the first extended position more quickly than the second beveled surfaces cause the second-segment members to move between the second retracted position and the second extended position.

10. The mold insert assembly of claim 9, further comprising a collar member disposed at least partially around the plurality of first-segment members and the plurality of second-segment members, the collar member being configured to inhibit movement of the plurality of first-segment members and the plurality of second-segment members beyond the first extended position and the second extended position, respectively.

11. The mold insert assembly of claim 10, wherein the collar member is configured to move the plurality of first-segment members towards the first retracted position.

12. The mold insert assembly of claim 11, wherein the collar member includes a collar-member-camming surface.

13. The mold insert assembly of claim 12, further comprising a spring member configured to bias the collar member to move towards the plurality of first-segment members and second-segment members, whereby the collar-member-camming surface moves the plurality of first-segment members and the plurality of second-segment members towards the first retracted position and the second retracted position, respectively.

14. A method of using a mold insert assembly, the mold insert assembly comprising a first driving member configured to move between a retracting position and an extending position, a plurality of first-segment members positioned to engage the first driving member and configured to move between a first retracted position and a first extended position when the first driving member moves between the retracting position and the extending position, respectively, and a plurality of second-segment members disposed proximate the plurality of first-segment members and configured to move between a second retracted position and a second extended position when the first driving member moves between the retracting position and the extending position, respectively, wherein the plurality of first-segment members and the plurality of second-segment members cooperate to form a substantially liquid-tight periphery when the first driving member is in the extending position and wherein the plurality of first-segment members and the plurality of second-segment members are configured to move towards the first retracted position and the second retracted position, respectively when the first driving member moves towards the retracting position, and wherein each first-segment member has a first longitudinal end having a first configuration, wherein each second-segment member has a second longitudinal end having a second configuration, the second configuration differing from the first configuration in a manner that causes each first-segment member to move towards the first retracted position prior to movement by each second-segment member towards the second retracted position, the method comprising the steps of:

inserting the mold insert assembly into a mold;

positioning the plurality of first-segment members and the plurality of second-segment members to form the substantially liquid-tight periphery;

introducing a liquid material into the mold;

cooling the liquid material until the liquid material becomes a solid material;

collapsing the plurality of first-segment members and the plurality of second-segments; and removing the mold insert assembly from the solid material.

* * * * *